US010183195B2

(12) United States Patent
Madson et al.

(10) Patent No.: US 10,183,195 B2
(45) Date of Patent: Jan. 22, 2019

(54) DIMPLE PATTERNS FOR GOLF BALLS

(71) Applicant: Acushnet Company, Fairhaven, MA (US)

(72) Inventors: Michael R. Madson, Easton, MA (US); Nicholas M. Nardacci, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 15/583,032

(22) Filed: May 1, 2017

(65) Prior Publication Data

US 2018/0311533 A1 Nov. 1, 2018

(51) Int. Cl.
*A63B 37/12* (2006.01)
*A63B 37/00* (2006.01)

(52) U.S. Cl.
CPC ..... *A63B 37/0006* (2013.01); *A63B 37/002* (2013.01); *A63B 37/0021* (2013.01)

(58) Field of Classification Search
CPC ..... A63B 37/0006
USPC ..... 473/373, 384
See application file for complete search history.

(56) References Cited

U.S. PATENT DOCUMENTS 5,044,638 A 9/1991 Nesbitt et al.
5,149,100 A 9/1992 Melvin et al.
5,158,300 A * 10/1992 Aoyama ..... A63B 37/0004 40/327
5,377,989 A 1/1995 Machin
5,562,552 A 10/1996 Thurman
5,766,098 A 6/1998 Molitor et al.
5,957,786 A 9/1999 Aoyama
6,010,442 A 1/2000 Lemons et al.
6,290,615 B1 9/2001 Ogg
6,299,552 B1 10/2001 Morgan et al.
6,338,684 B1 1/2002 Winfield et al.
6,358,161 B1 3/2002 Aoyama
6,361,453 B1 3/2002 Nakamura et al.
6,394,912 B1 5/2002 Nakamura et al.
6,431,998 B1 5/2002 Nakamura et al.
6,461,253 B2 10/2002 Ogg
6,533,684 B2 3/2003 Winfield et al.
6,669,143 B1 12/2003 Johnson
6,682,441 B2 1/2004 Winfield et al.
6,682,442 B2 * 1/2004 Winfield ..... A63B 37/0004 473/378
6,729,976 B2 5/2004 Bissonnette et al.
6,749,525 B2 6/2004 Aoyama
6,849,007 B2 1/2005 Morgan et al.
7,503,856 B2 3/2009 Nardacci et al.
2013/0040760 A1 * 2/2013 Madson ..... A63B 37/0006 473/379

* cited by examiner

*Primary Examiner* — Raeann Gorden
(74) *Attorney, Agent, or Firm* — Mandi B. Milbank

(57) ABSTRACT

A golf ball dimple pattern based on a hexagonal dipyramid is disclosed. The dimples are arranged based on six substantially similar dimple sections on each of the two hemispheres of the ball.

24 Claims, 9 Drawing Sheets

DIMPLE PATTERNS FOR GOLF BALLS

FIELD OF THE INVENTION

The present invention relates to golf ball dimple patterns that are defined by a hexagonal dipyramid.

BACKGROUND OF THE INVENTION

Golf ball dimple patterns based on hexagonal dipyramids are known. For example, U.S. Pat. No. 7,503,856 to Nardacci et al., the entire disclosure of which is hereby incorporated herein by reference, discloses a dimple pattern based on a hexagonal dipyramid wherein the nearest neighbor dimples have a diameter ratio of about 1.5 or greater. However, a continuing need exists for dimple patterns, including patterns based on hexagonal dipyramids, with novel aerodynamic characteristics.

SUMMARY OF THE INVENTION

The present invention is directed to a golf ball having a plurality of dimples arranged in a pattern defined by a hexagonal dipyramid projected on the spherical outer surface of the ball. The dimples cover at least 78% of the outer surface. The dimple pattern consists of twelve substantially identical dimple sections. Each of the twelve dimple sections comprises at least three different dimple diameters. The largest dimple diameter ratio among nearest neighbor dimples on the ball is 1.5. In a particular embodiment, each dimple section comprises at least two different chord depths. In another particular embodiment, the majority of the dimples on the ball are spherical dimples, the spherical dimples have an average edge angle of from 12 to 15, and the maximum difference of the edge angles between any two spherical dimples on the ball is less than 2 degrees.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION

Figure 1A:
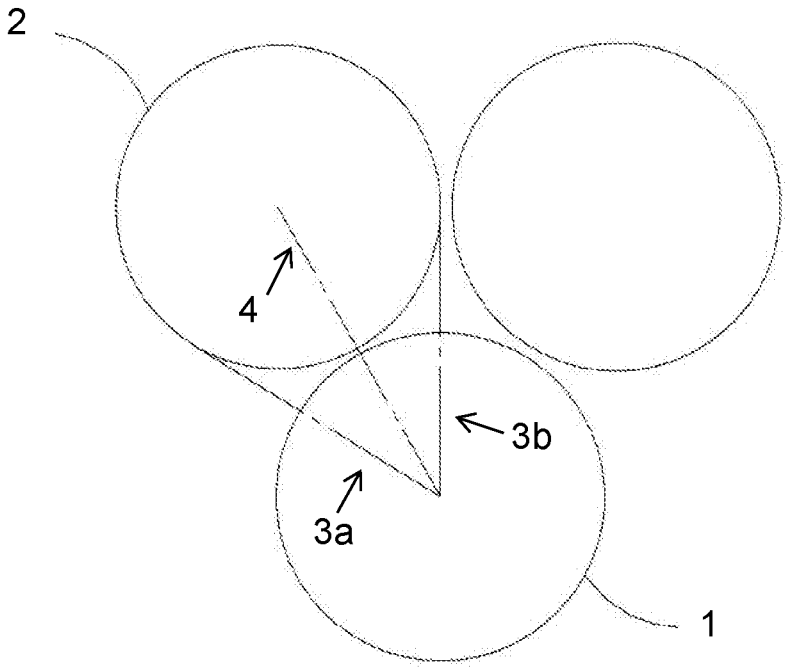
FIGS. 1A and 1B illustrate a method for determining nearest neighbor dimples.

A hexagonal dipyramid is a polyhedron formed from two hexagonal pyramids joined at their bases. The resulting solid has twelve triangular faces, eight vertices, and eighteen edges. Each of the twelve triangular faces has two side edges and a base edge.

Golf ball dimple patterns of the present invention are based on hexagonal dipyramids. Thus, dimple patterns of the present invention consist of six dimple sections on each of the two hemispheres of the ball. The two side edges of the dimple sections are straight lines corresponding to the linear side edges of the dipyramid on which the dimple pattern is based. Each side edge runs longitudinally from a base edge to the pole of a hemisphere. As discussed further below, the side edges may intersect one or more dimples. The base edges of the dimple sections are defined such that the base edges do not intersect any dimples. In one embodiment, the golf ball has a planar parting line wherein no dimples intersect the equatorial plane, and the base edges are straight lines corresponding to the linear base edges of the dipyramid on which the dimple pattern is based. In another embodiment, the golf ball has a non-planar parting line wherein at least a portion of the dimples located adjacent to the equator intersect the equatorial plane, and the base edges are non-linear segments drawn along the linear base edges of the dipyramid on which the dimple pattern is based such that no dimples are intersected. In a particular aspect of this embodiment, the dimples that are located adjacent to the base edge are same diameter dimples. In another particular aspect of this embodiment, the dimples that are located adjacent to the base edge have diameters that are different by at least 0.005 inches and no more than 0.030 inches.

Dimples may be located entirely within a dimple section (i.e., the dimple perimeter is not intersected by a side edge) or dimples may be shared between two or more sections. For every dimple that is not located entirely within a dimple section the centroid of the dimple is located either at a hemispherical pole or along a side edge. Dimple patterns of the present invention preferably include at least one dimple that lies along the straight side edges of the dimple sections. In a particular embodiment, at least one dimple having the minimum dimple diameter is located along the straight side edges. In another particular embodiment, at least one dimple having the maximum dimple diameter is located along the straight side edges. In another particular embodiment, at least one dimple having the minimum dimple diameter and at least one dimple having the maximum dimple diameter are located along the straight side edges.

The six dimple sections on each hemisphere are substantially identical to each other. In a preferred embodiment, all twelve dimple sections on the ball are substantially identical to each other. For purposes of the present disclosure, dimple sections are "substantially identical" if they have substantially the same dimple arrangement (i.e., the relative positions of their dimples' centroids are about the same) and substantially the same dimple characteristics (e.g., plan shape, cross-sectional shape, diameter, edge angle, etc.). Thus, for each dimple located entirely within a particular section on a hemisphere, there is a corresponding dimple in each of the other five dimple sections of that hemisphere. For dimples having a centroid located along a side edge, there is a corresponding dimple located along each of the other five side edges of that hemisphere. Polar dimples, which may be but are not necessarily present in dimple patterns of the present invention, are shared between all six sections on a hemisphere, and, thus, have no corresponding dimple on that hemisphere. For each set of corresponding dimples, the relative positions of the dimple centroids within their respective sections are about the same, and each of the dimples within that set of corresponding dimples has substantially the same characteristics.

The dimples are preferably arranged such that there are no dimple free great circles on the outer surface of the ball.

In a particular embodiment, the dimples are arranged within the dimple sections such that at least a portion of nearest neighbor dimples have a diameter ratio, defined herein as the ratio of the diameter of the larger of two dimples to the diameter of the smaller of two dimples, of less than 1.5. In another particular embodiment, the dimples are arranged within the dimple sections such that all nearest neighbor dimples have a diameter ratio of less than 1.5. In another particular embodiment, the dimples are arranged within the dimple sections such that at least a portion of nearest neighbor dimples have a diameter ratio of 1.0 or 1.2 or 1.3 or 1.4 or 1.5 or 1.8 or 2.0 or 2.5 or 3.0 or at least a portion of nearest neighbor dimples have a diameter ratio within a range having a lower limit and an upper limit selected from these values. In another particular embodiment, the dimples are arranged within the dimple sections such that all nearest neighbor dimples have a diameter ratio of 1.0 or 1.2 or 1.3 or 1.4 or 1.5 or 1.8 or 2.0 or 2.5 or 3.0 or all nearest neighbor dimples have a diameter ratio within a range having a lower limit and an upper limit selected from these values.

Figure 1B:
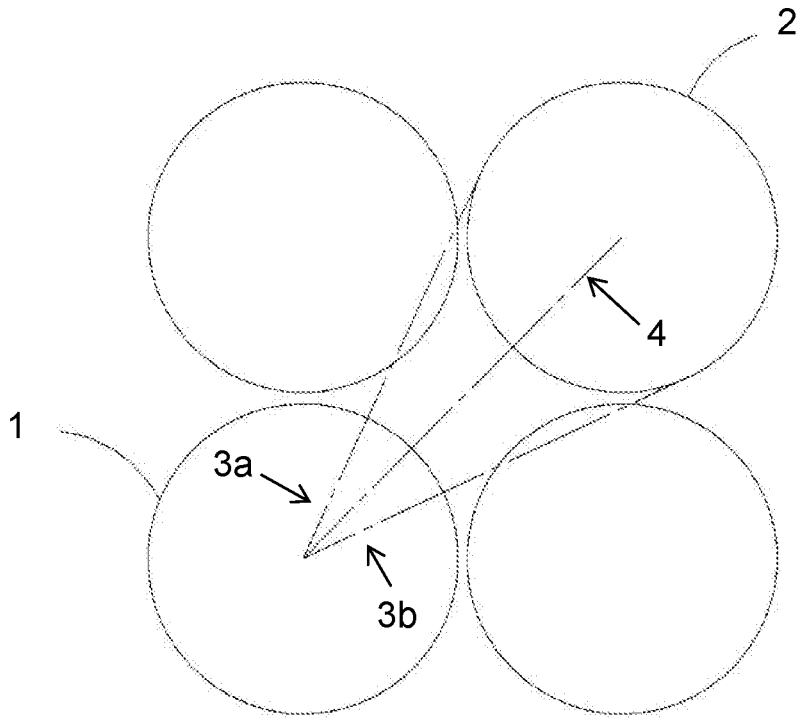

For purposes of the present invention, nearest neighbor dimples are determined according to the following method. A reference dimple and a potential nearest neighbor dimple are selected such that the reference dimple has substantially the same diameter or a smaller diameter than the potential nearest neighbor dimple. Two tangency lines are drawn from the center of the reference dimple to the potential nearest neighbor dimple. A line segment is then drawn connecting the center of the reference dimple to the center of the potential nearest neighbor dimple. If the two tangency lines and the line segment do not intersect any other dimple edges, then those dimples are considered to be nearest neighbors. For example, as shown in FIG. 1A, two tangency lines 3A and 3B are drawn from the center of a reference dimple 1 to a potential nearest neighbor dimple 2. Line segment 4 is then drawn connecting the center of reference dimple 1 to the center of potential nearest neighbor dimple 2. Tangency lines 3A and 3B and line segment 4 do not intersect any other dimple edges, so dimple 1 and dimple 2 are considered nearest neighbors. In FIG. 1B, two tangency lines 3A and 3B are drawn from the center of a reference dimple 1 to a potential nearest neighbor dimple 2. Line segment 4 is then drawn connecting the center of reference dimple 1 to the center of potential nearest neighbor dimple 2. Tangency lines 3A and 3B intersect an alternative dimple, so dimple 1 and dimple 2 are not considered nearest neighbors. Those skilled in the art will recognize that the line segments do not actually have to be drawn on the golf ball. Rather, a computer modeling program capable of performing this operation automatically is preferably used.

Figure 2:
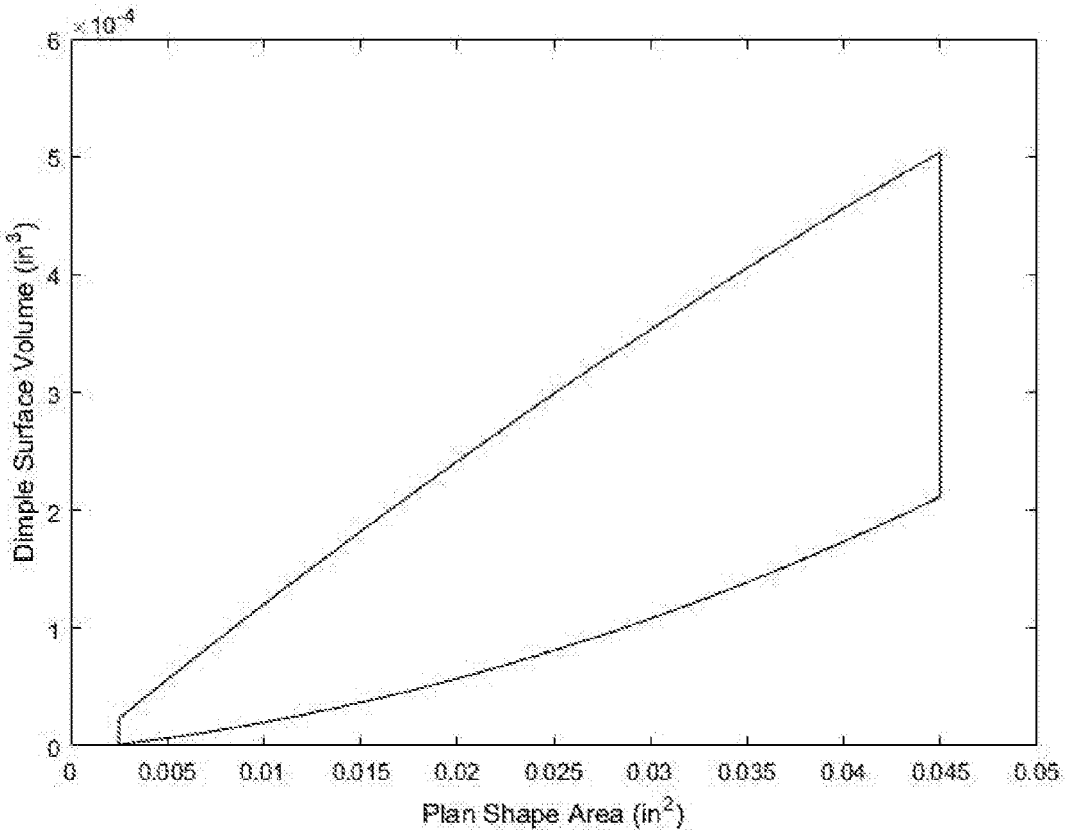
FIG. 2 is a graphical representation of the relationship between dimple volume and plan shape area according to an embodiment of the present invention.

Dimples of the present invention may have a variety of plan shapes, including, but not limited to, circular, polygonal, oval, or irregular shapes, and a variety of profile shapes, including, but not limited to, circular, catenary, elliptical, or conical shapes. Suitable non-spherical dimples preferably have a plan shape area and dimple volume within a range having a lower limit and an upper limit selected from the values within the region shown in FIG. 2, which is a graphical representation of the relationship between dimple volume and plan shape area of non-spherical dimples according to an embodiment of the present invention. The preferred dimple volume, $V_s$, has a lower limit calculated by $$V_s=-0.0464x^2+0.0135x-1.00\times10^{-5},$$

wherein $0.0025\leq x\leq0.045$, and an upper limit calculated by $$V_s=0.0703x^2+0.0016x-3.00\times10^{-6},$$

wherein $0.0025\leq x\leq0.045$.

For purposes of the present invention, the plan shape area of a non-spherical dimple is based on a planar view of the dimple plan shape, such that the viewing plane is normal to an axis connecting the center of the ball to the point of the calculated surface depth. The dimple volume is the total volume encompassed by the dimple shape and the surface of the golf ball.

Figure 3:
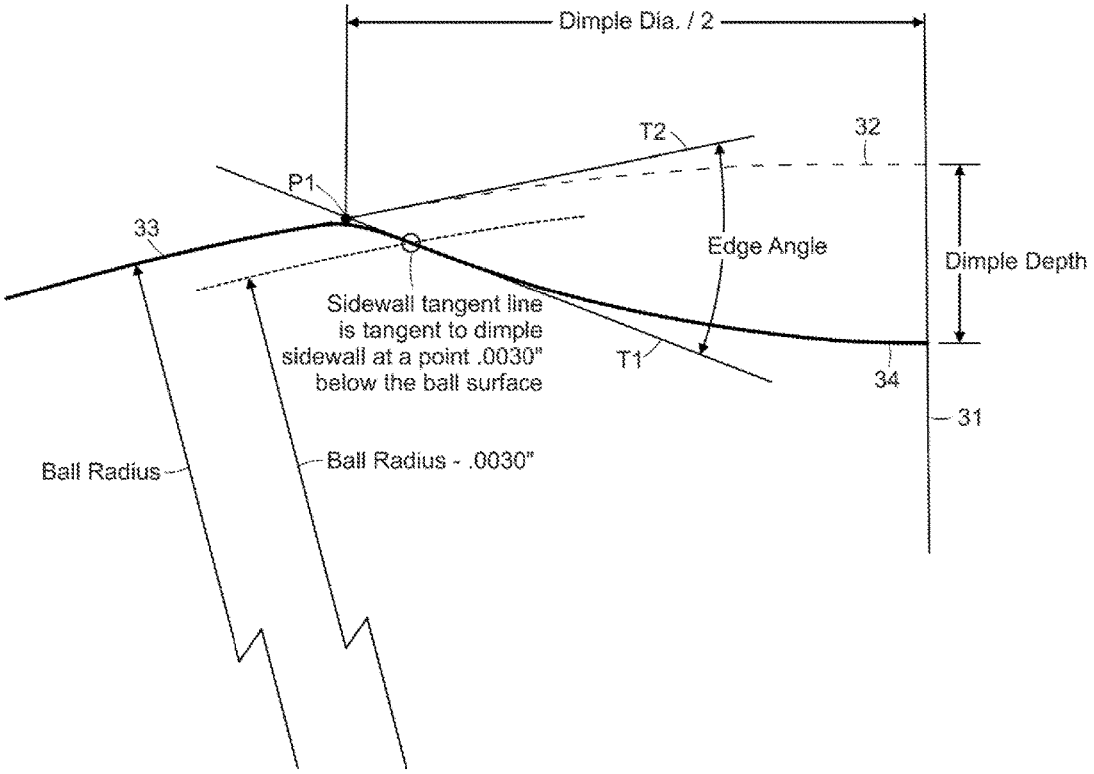
FIG. 3 is a schematic diagram illustrating a method for measuring the diameter of a dimple.

Each dimple on the outer surface of the ball preferably has a diameter of 0.050 or 0.060 or 0.070 or 0.080 or 0.090 or 0.100 or 0.110 or 0.120 or 0.180 or 0.190 or 0.200 or 0.205 or 0.210 or 0.220 or 0.250 inches or a diameter within a range having a lower limit and an upper limit selected from these values. In a particular embodiment, the maximum difference between any two dimple diameters on the ball is less than 0.055 inches. In another particular embodiment, the maximum difference between any two dimple diameters on the ball is 0.035 inches or greater, or 0.060 inches or greater. The diameter of a dimple having a non-circular plan shape is defined by its equivalent diameter, $d_e$, which calculated as:

$$d_e = 2\sqrt{\frac{A}{\pi}}$$

where A is the plan shape area of the dimple. Diameter measurements are determined on finished golf balls according to FIG. 3. Generally, it may be difficult to measure a dimple's diameter due to the indistinct nature of the boundary dividing the dimple from the ball's undisturbed land surface. Due to the effect of paint and/or the dimple design itself, the junction between the land surface and dimple may not be a sharp corner and is therefore indistinct. This can make the measurement of a dimple's diameter somewhat ambiguous. To resolve this problem, dimple diameter on a finished golf ball is measured according to the method shown in FIG. 3. FIG. 3 shows a dimple half-profile 34, extending from the dimple centerline 31 to the land surface outside of the dimple 33. A ball phantom surface 32 is constructed above the dimple as a continuation of the land surface 33. A first tangent line T1 is then constructed at a point on the dimple sidewall that is spaced 0.003 inches radially inward from the phantom surface 32. T1 intersects phantom surface 32 at a point P1, which defines a nominal dimple edge position. A second tangent line T2 is then constructed, tangent to the phantom surface 32, at P1. The edge angle is the angle between T1 and T2. The dimple diameter is the distance between P1 and its equivalent point diametrically opposite along the dimple perimeter. Alternatively, it is twice the distance between P1 and the dimple centerline 31, measured in a direction perpendicular to centerline 31. The dimple depth is the distance measured along a ball radius from the phantom surface of the ball to the deepest point on the dimple. The dimple volume is the space enclosed between the phantom surface 32 and the dimple surface 34 (extended along T1 until it intersects the phantom surface).

In a particular embodiment, a majority of the dimples on the outer surface of golf balls of the present invention are spherical dimples, i.e., dimples having a circular plan shape and a profile shape based on a spherical function. In a particular aspect of this embodiment, the spherical dimples have one or more properties/characteristics selected from:

a) the edge angle of each spherical dimple is 10 or 11 or 12 or 13 or 14 or 15 or 16 degrees, or is within a range having a lower limit and an upper limit selected from these values;
b) the maximum difference in edge angle between any two of the spherical dimples is 1 degree;
c) the edge angle of all of the spherical dimples is substantially the same (For purposes of the present disclosure, edge angles on a finished ball are substantially the same if they differ by less than 0.25 degrees.);
d) the average edge angle of the spherical dimples is from 12 to 15 degrees; and
e) the chord depth of same diameter spherical dimples is substantially the same (For purposes of the present invention, chord depths on a finished ball are substantially the same if they differ by 0.0003 inches or less.).

The number of different dimple diameters on the outer surface of the ball is preferably 15 or less, or 10 or less, or 8 or less, or 6 or less, or 4 or less. Alternatively, the number of different dimple diameters on the outer surface of the ball is preferably 3 or more, or 4 or more, or 5 or more, or 6 or more. It should be understood that manufacturing variances are to be taken into account when determining the number of different dimple diameters. For purposes of the present disclosure, dimples having substantially the same diameter, also referred to herein as "same diameter" dimples, includes dimples on a finished ball having respective diameters that differ by less than 0.005 inches due to manufacturing variances.

It may be desirable for the dimple pattern to include one or more dimples that overlap. One advantage of overlapping dimples is that the surface coverage of the dimple pattern may be increased. One example of a dimple pattern with overlapping dimples is described in U.S. Patent Application Publication No. 2005/0137032 to Aoyama et al., the entire disclosure of which is hereby incorporated herein by reference.

Dimple patterns generated by the present invention are capable of achieving a high percentage of surface coverage, which may optionally be further increased using overlapping dimples. In a particular embodiment, the present invention generates a surface coverage of about 75% or greater. In another particular embodiment, the present invention generates a surface coverage of about 78% or greater. In another particular embodiment, the present invention generates a surface coverage of about 80% or greater. In another particular embodiment, the present invention generates a surface coverage of about 82% or greater.

The total number of dimples on the golf ball may also be varied according to the present invention. The total number of dimples may be based on, for example, the number of differently sized dimples, the maximum and minimum diameters of the dimples, the dimple arrangement, and the like. Preferably, the total number of dimples is between about 250 and about 500. In a particular embodiment, the total number of dimples is 252 or 254 or 264 or 266 or 276 or 278 or 288 or 290 or 300 or 302 or 312 or 314 or 324 or 326 or 336 or 338 or 348 or 350 or 360 or 362 or 372 or 374 or 384 or 386 or 396 or 398 or 408 or 410 or 420 or 422 or the total number of dimples is within a range having a lower limit and an upper limit selected from these values.

Aerodynamic characteristics of golf balls of the present invention can be described by aerodynamic coefficient magnitude and aerodynamic force angle. Based on a dimple pattern generated according to the present invention, in one embodiment, the golf ball achieves an aerodynamic coefficient magnitude of from 0.25 to 0.32 and an aerodynamic force angle of from 30° to 38° at a Reynolds Number of 230000 and a spin ratio of 0.085. Based on a dimple pattern generated according to the present invention, in another embodiment, the golf ball achieves an aerodynamic coefficient magnitude of from 0.26 to 0.33 and an aerodynamic force angle of from 32° to 40° at a Reynolds Number of 180000 and a spin ratio of 0.101. Based on a dimple pattern generated according to the present invention, in another embodiment, the golf ball achieves an aerodynamic coefficient magnitude of from 0.27 to 0.37 and an aerodynamic force angle of from 35° to 44° at a Reynolds Number of 133000 and a spin ratio of 0.133. Based on a dimple pattern generated according to the present invention, in another embodiment, the golf ball achieves an aerodynamic coefficient magnitude of from 0.32 to 0.45 and an aerodynamic force angle of from 39° to 45° at a Reynolds Number of 89000 and a spin ratio of 0.183. For purposes of the present disclosure, aerodynamic coefficient magnitude ($C_{mag}$) is defined by $C_{mag}=(C_L^2+C_D^2)^{1/2}$ and aerodynamic force angle ($C_{angle}$) is defined by $C_{angle}=\tan^{-1}(C_L/C_D)$, where $C_L$ is a lift coefficient and $C_D$ is a drag coefficient. Aerodynamic characteristics of a golf ball, including aerodynamic coefficient magnitude and aerodynamic force angle, are disclosed, for example, in U.S. Pat. No. 6,729,976 to Bissonnette et al., the entire disclosure of which is hereby incorporated herein by reference. Aerodynamic coefficient magnitude and aerodynamic force angle values are calculated using the average lift and drag values obtained when 30 balls are tested in a random orientation. Reynolds number is an average value for the test and can vary by plus or minus 3%. Spin ratio is an average value for the test and can vary by plus or minus 5%.

Golf balls of the present invention are not limited by a particular golf ball construction. The golf ball may have any type of core, such as solid, liquid, wound, and the like, and may be a one-piece, two-piece, or multilayer ball. Each layer of the golf ball may be constructed from any suitable thermoset or thermoplastic material known to those of ordinary skill in the art. When desirable, the cover may be coated with any number of layers, such as a base coat, top coat, paint, or any other desired coating. As will be appreciated by those skilled in the art, any manufacturing technique may be used to construct the various portions of the golf ball.

Non-Limiting Exemplary Dimple Pattern 1

Figure 4:
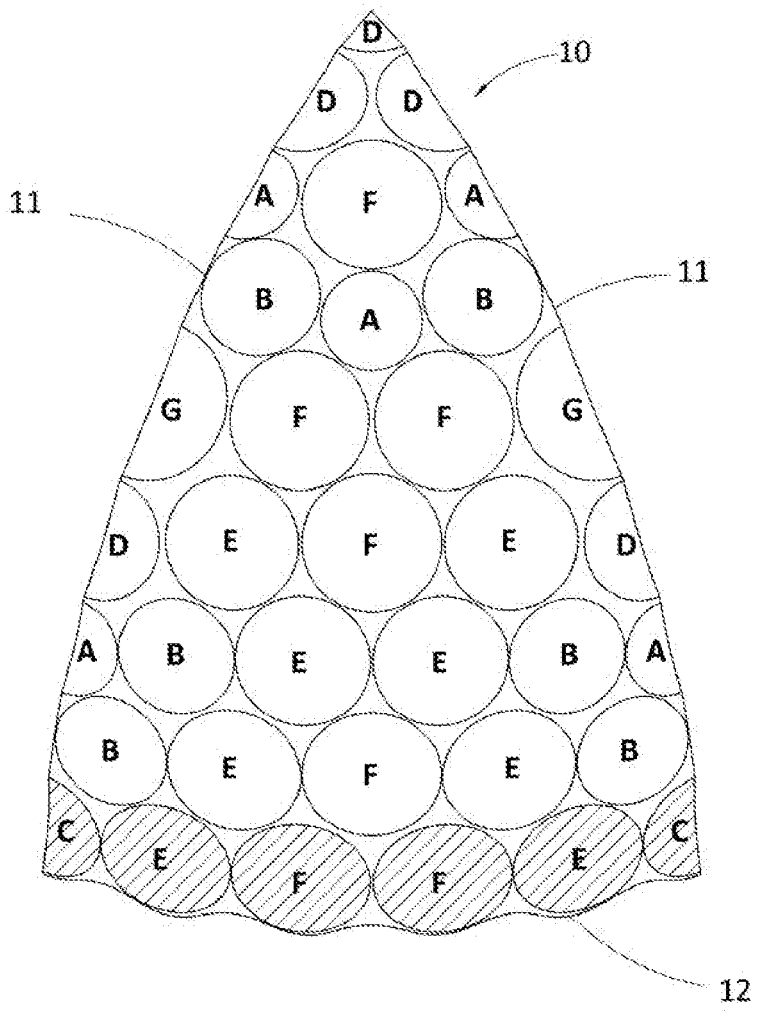
FIG. 4 illustrates a dimple section according to an embodiment of the present invention.
Figure 5:
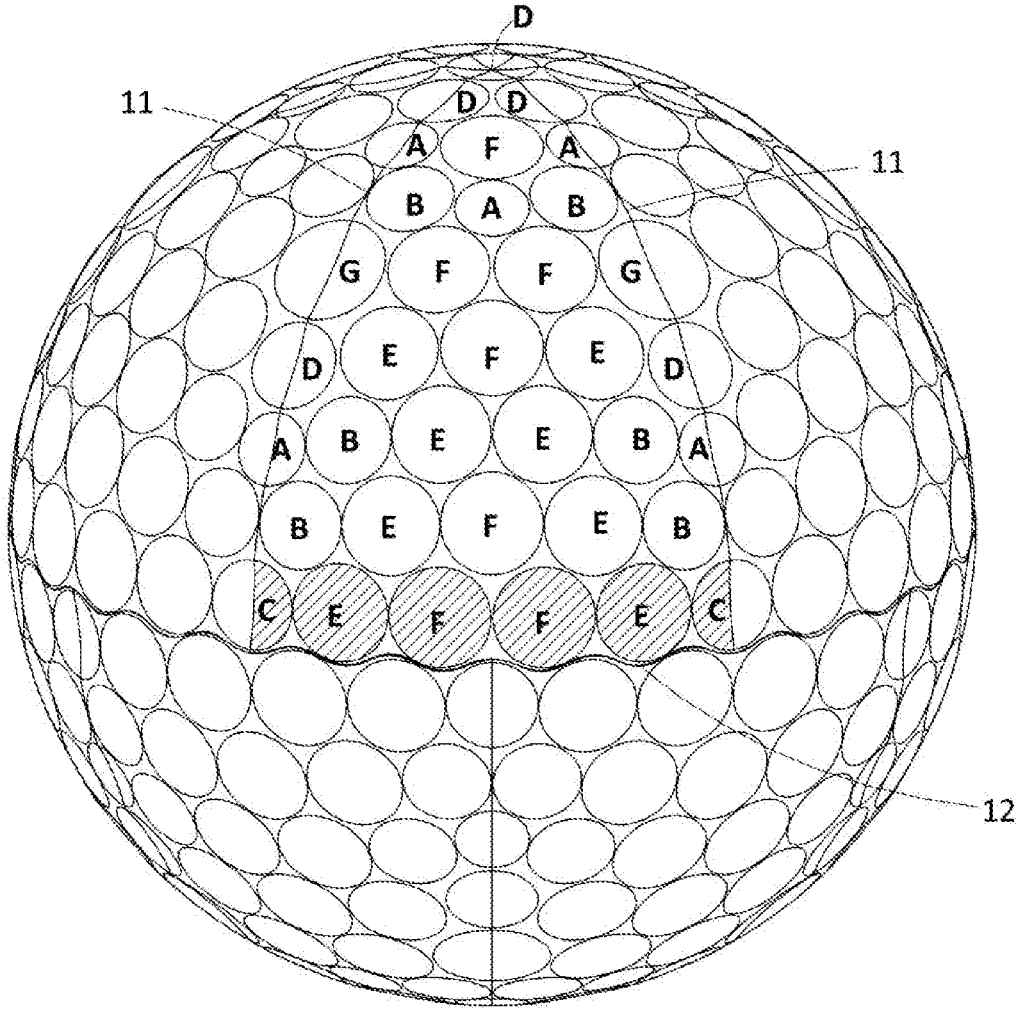
FIG. 5 illustrates a golf ball having a dimple pattern according to the embodiment shown in FIG. 4.
Figure 6:
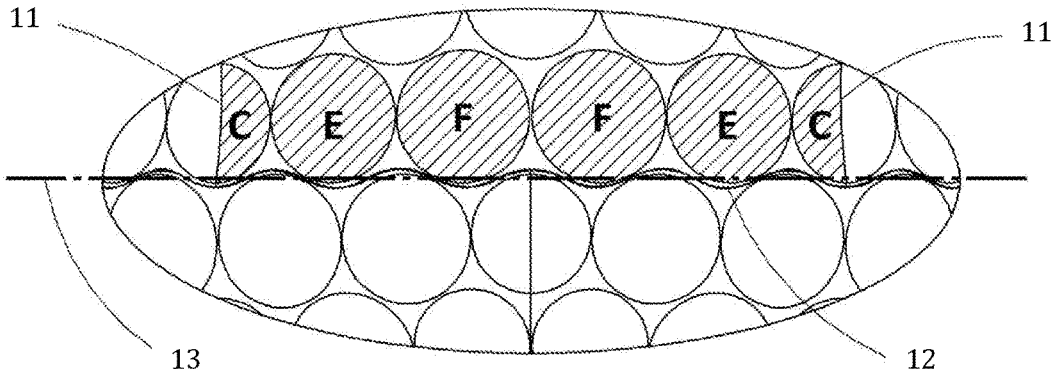
FIG. 6 is an enlarged view of a portion of the golf ball shown in FIG. 5.

A dimple pattern according to a particular embodiment of the present invention is illustrated in FIGS. 4-6. FIG. 4 shows a dimple section 10 packed with dimples and having two side edges 11 and a base edge 12. FIG. 5 shows the dimple section 10 of FIG. 4 patterned around a golf ball. The resulting overall dimple pattern has a total of 338 dimples, with a surface coverage of about 84%.

In FIGS. 4-6, the alphabetic labels within the dimples designate same diameter dimples; i.e., all dimples labelled A have substantially the same diameter, all dimples labelled B have substantially the same diameter, and so on. In a particular aspect of the embodiment illustrated in FIGS. 4-6, the alphabetic labels within the dimples designate dimples having the same dimple diameter, chord depth, and edge angle. In a further particular aspect of the embodiment illustrated in FIGS. 4-6, the dimples labelled A-G have the diameter, chord depth, and edge angle values given in Table 1 below:

TABLE 1

| Alphabetic Label | Dimple Diameter (inches) | Chord Depth (inches) | Edge Angle (degrees) |
|---|---|---|---|
| A | 0.130 | 0.0047 | 12.75 |
| B | 0.155 | 0.0051 | 12.75 |
| C | 0.160 | 0.0051 | 12.75 |
| D | 0.169 | 0.0052 | 12.75 |
| E | 0.174 | 0.0052 | 12.75 |
| F | 0.179 | 0.0052 | 12.75 |
| G | 0.205 | 0.0052 | 12.75 |

Thus, according to the embodiment shown in FIGS. 4-6, and wherein the dimples have properties according to Table 1, the dimples having a total of seven different dimple diameters, including a maximum dimple diameter of 0.205 and a minimum dimple diameter of 0.130. The largest dimple diameter ratio among nearest neighbor dimples on the ball is 1.4, which is the dimple diameter ratio of the A and F nearest neighbor dimples. The centroid of at least one dimple having the maximum dimple diameter (i.e., at least one G dimple) and the centroid of at least one dimple having the minimum dimple diameter (i.e., at least one A dimple) lie on the side edges. The maximum difference between any two diameters is 0.075 inches. The dimples located adjacent to the equator, as designated by shading in FIGS. 4-6, include three different dimple diameters, with a maximum difference in diameter of 0.019 inches. All of the dimples located adjacent to the equator intersect the equatorial plane, as shown in FIG. 6, which illustrates a detailed view of the dimples adjacent to the equator 13. The dimple pattern has a rotational offset between the two hemispheres of about 30 degrees.

Non-Limiting Exemplary Dimple Pattern 2

Figure 7:
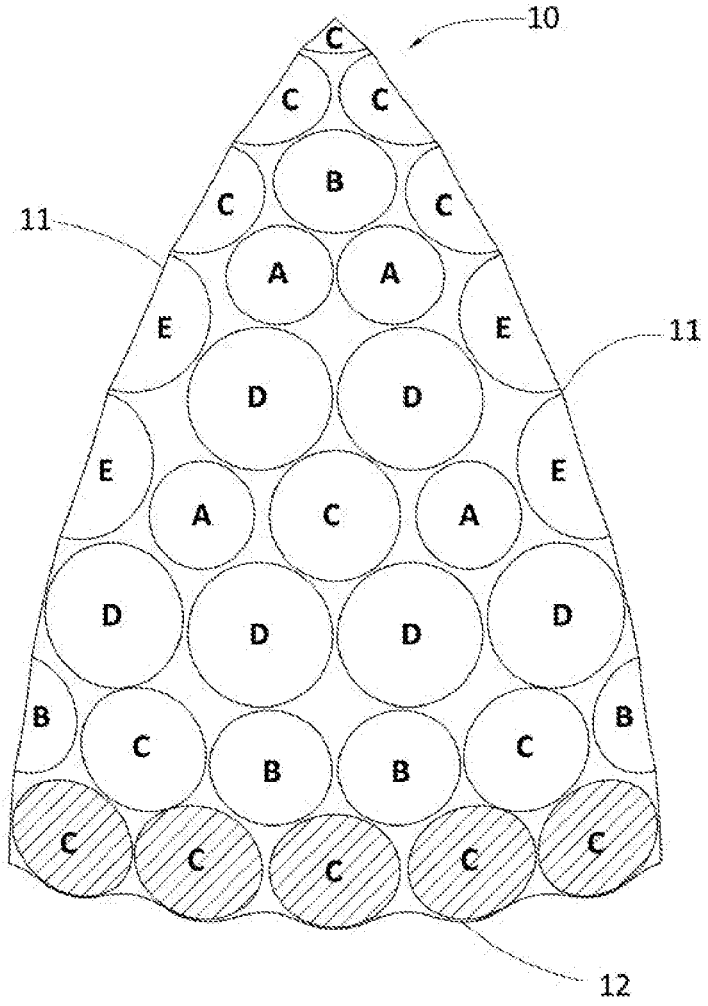
FIG. 7 illustrates a dimple section according to an embodiment of the present invention.
Figure 8:
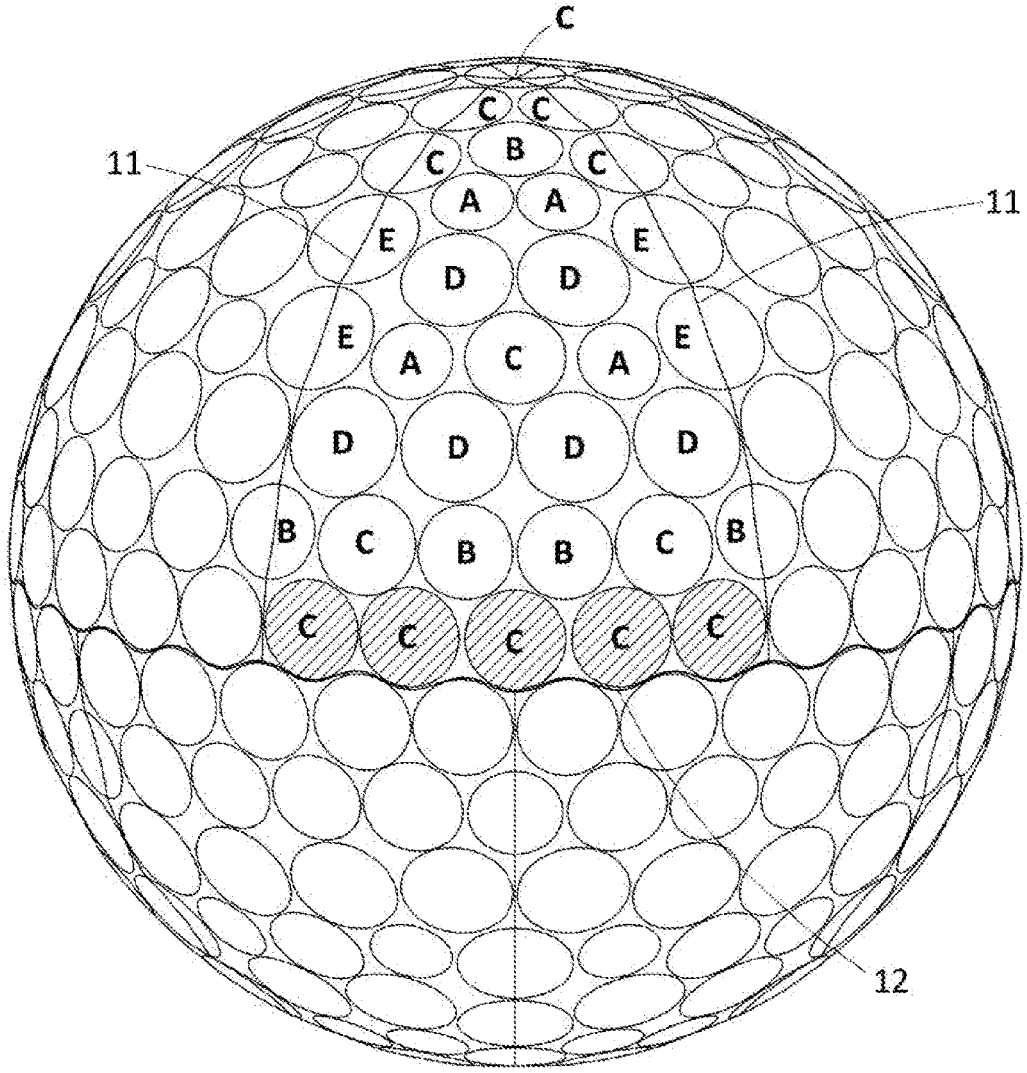
FIG. 8 illustrates a golf ball having a dimple pattern according to the embodiment shown in FIG. 7.
Figure 9:
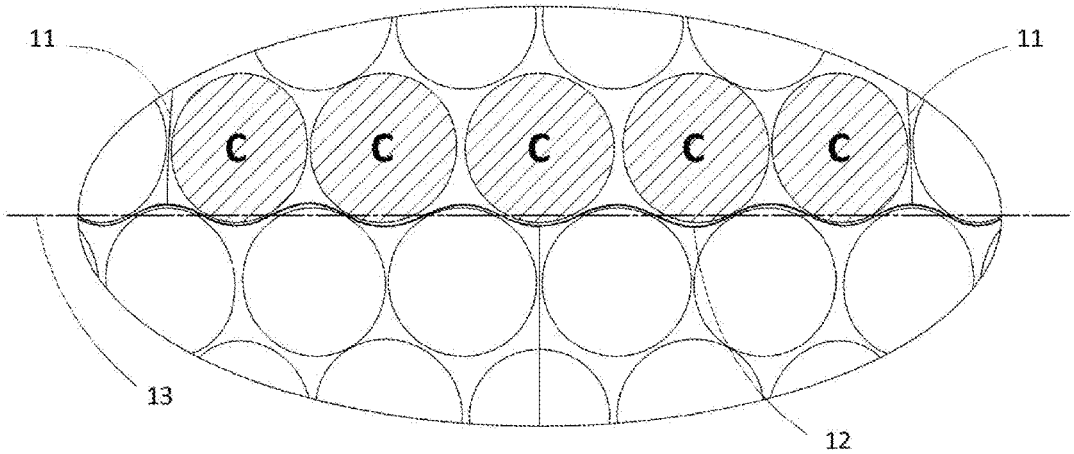
FIG. 9 is an enlarged view of a portion of the golf ball shown in FIG. 8.

A dimple pattern according to another particular embodiment of the present invention is illustrated in FIGS. 7-9. FIG. 7 shows a dimple section 10 packed with dimples and having two side edges 11 and a base edge 12. FIG. 8 shows the dimple section 10 of FIG. 7 patterned around a golf ball. The resulting overall dimple pattern has a total of 314 dimples, with a surface coverage of about 82%.

In FIGS. 7-9, the alphabetic labels within the dimples designate same diameter dimples; i.e., all dimples labelled A have substantially the same diameter, all dimples labelled B have substantially the same diameter, and so on. In a particular aspect of the embodiment illustrated in FIGS. 7-9, the alphabetic labels within the dimples designate dimples having the same dimple diameter, chord depth, and edge angle. In a further particular aspect of the embodiment illustrated in FIGS. 7-9, the dimples labelled A-E have the diameter, chord depth, and edge angle values given in Table 2 below:

TABLE 2

| Alphabetic Label | Dimple Diameter (inches) | Chord Depth (inches) | Edge Angle (degrees) |
|---|---|---|---|
| A | 0.140 | 0.0054 | 13.50 |
| B | 0.150 | 0.0054 | 13.50 |
| C | 0.170 | 0.0058 | 13.50 |
| D | 0.190 | 0.0060 | 13.50 |
| E | 0.195 | 0.0060 | 13.50 |

Thus, according to the embodiment shown in FIGS. 7-9, and wherein the dimples have properties according to Table 2, the dimples having a total of five different dimple diameters, including a maximum dimple diameter of 0.195 and a minimum dimple diameter of 0.140. The largest dimple diameter ratio among nearest neighbor dimples on the ball is 1.4, which is the dimple diameter ratio of the A and E nearest neighbor dimples. The centroid of at least one dimple having the maximum dimple diameter (i.e., at least one E dimple) lies on the side edges. Every dimple having the minimum dimple diameter (i.e., every A dimple) is located entirely within a dimple section. The maximum difference between any two diameters is 0.055 inches. The dimples located adjacent to the equator, as designated by shading in FIGS. 7-9, are same diameter dimples. All of the dimples located adjacent to the equator intersect the equatorial plane, as shown in FIG. 9, which illustrates a detailed view of the dimples adjacent to the equator 13. The dimple pattern has a rotational offset between the two hemispheres of about 30 degrees.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having a plurality of dimples covering at least 78% of the spherical outer surface thereof, wherein the dimples are arranged in a pattern defined by a hexagonal dipyramid projected on the spherical outer surface of the ball, the pattern consisting of twelve substantially identical dimple sections, wherein each of the twelve dimple sections comprises at least three different dimple diameters and at least two different chord depths, wherein the largest dimple diameter ratio among nearest neighbor dimples on the ball is 1.4 or less, wherein there are no dimple free great circles on the outer surface of the ball; wherein the border of each of the dimple sections consists of two linear side edges and a non-linear base edge; wherein each dimple section consists of a plurality of shared non-polar dimples each of which has a centroid that lies along a side edge of the section, a plurality of dimples that are not intersected by a side edge, and, optionally, a shared polar dimple having a centroid that lies at the vertex of the two linear side edges of the section; wherein the dimples within each dimple section that are located adjacent to the base edge of the section include dimples having at least three dimple diameters that differ by at least 0.005 inches.

2. The golf ball of claim 1, wherein each dimple section consists of the shared non-polar dimples and the dimples that are not intersected by a side edge.

3. The golf ball of claim 1, wherein each dimple section comprises at least one minimum diameter dimple and at least one maximum diameter dimple, and wherein at least one of the minimum diameter dimple(s) is a shared dimple having a centroid that lies along a side edge of the section.

4. The golf ball of claim 1, wherein each dimple section comprises at least one minimum diameter dimple and at least one maximum diameter dimple, and wherein at least one of the maximum diameter dimple(s) is a shared dimple having a centroid that lies along a side edge of the section.

5. The golf ball of claim 1, wherein each dimple section comprises at least one minimum diameter dimple and at least one maximum diameter dimple, and wherein at least one of the minimum diameter dimple(s) and at least one of the maximum diameter dimple(s) is a shared dimple having a centroid that lies along a side edge of the section.

6. The golf ball of claim 1, wherein the maximum difference in diameter between any two dimples located adjacent to the base edge of a section is 0.030 inches.

7. The golf ball of claim 1, wherein the plurality of dimples cover at least 82% of the spherical outer surface of the ball.

8. The golf ball of claim 1, wherein each dimple has a diameter of 0.120 inches or greater.

9. The golf ball of claim 1, wherein the maximum difference between any two dimple diameters is less than 0.055 inches.

10. The golf ball of claim 1, wherein the maximum difference between any two dimple diameters is greater than 0.060 inches.

11. The golf ball of claim 1, wherein each of the dimple sections comprises at least four different dimple diameters.

12. The golf ball of claim 1, wherein each of the dimple sections comprises at least five different dimple diameters.

13. A golf ball having a plurality of dimples covering at least 78% of the spherical outer surface thereof, wherein the dimples are arranged in a pattern defined by a hexagonal dipyramid projected on the spherical outer surface of the ball, the pattern consisting of twelve substantially identical dimple sections, wherein each of the twelve dimple sections comprises at least three different dimple diameters, the largest dimple diameter ratio among nearest neighbor dimples on the ball is 1.4 or less; wherein the border of each of the dimple sections consists of two linear side edges and a non-linear base edge; wherein each dimple section consists of a plurality of shared non-polar dimples each of which has a centroid that lies along a side edge of the section, a plurality of dimples that are not intersected by a side edge, and, optionally, a shared polar dimple having a centroid that lies at the vertex of the two linear side edges of the section; wherein the dimples within each dimple section that are located adjacent to the base edge of the section include dimples having at least three dimple diameters that differ by at least 0.005 inches; wherein a majority of the dimples on the ball are spherical dimples, the spherical dimples have an average edge angle of from 12 to 15, the maximum difference of the edge angles between any two spherical dimples on the ball is less than 2 degrees, and there are no dimple free great circles on the outer surface of the ball.

14. The golf ball of claim 13, wherein each dimple section consists of the shared non-polar dimples and the dimples that are not intersected by a side edge.

15. The golf ball of claim 13, wherein each dimple section comprises at least one minimum diameter dimple and at least one maximum diameter dimple, and wherein at least one of the minimum diameter dimple(s) is a shared dimple having a centroid that lies along a side edge of the section.

16. The golf ball of claim 13, wherein each dimple section comprises at least one minimum diameter dimple and at least one maximum diameter dimple, and wherein at least one of the maximum diameter dimple(s) is a shared dimple having a centroid that lies along a side edge of the section.

17. The golf ball of claim 13, wherein each dimple section comprises at least one minimum diameter dimple and at least one maximum diameter dimple, and wherein at least one of the minimum diameter dimple(s) and at least one of the maximum diameter dimple(s) is a shared dimple having a centroid that lies along a side edge of the section.

18. The golf ball of claim 13, wherein the maximum difference in diameter between any two dimples located adjacent to the base edge of a section is 0.030 inches.

19. The golf ball of claim 13, wherein the plurality of dimples cover at least 82% of the spherical outer surface of the ball.

20. The golf ball of claim 13, wherein each dimple has a diameter of 0.120 inches or greater.

21. The golf ball of claim 13, wherein the maximum difference between any two dimple diameters is less than 0.055 inches.

22. The golf ball of claim 13, wherein the maximum difference between any two dimple diameters is greater than 0.060 inches.

23. The golf ball of claim 13, wherein each of the dimple sections comprises at least four different dimple diameters.

24. The golf ball of claim 13, wherein each of the dimple sections comprises at least five different dimple diameters.

* * * * *